United States Patent [19]

Andersson

[11] 4,296,871

[45] Oct. 27, 1981

[54] RECEPTACLE WITH A COVER OF PLASTICS MATERIAL

[75] Inventor: Poul G. Andersson, Salzburg, Austria

[73] Assignee: Ring Lock Container S. A., Panama City, Panama

[21] Appl. No.: 59,685

[22] Filed: Jul. 23, 1979

[51] Int. Cl.[3] ..... B65D 43/10; B65D 43/03; B65D 17/28

[52] U.S. Cl. ..... 220/306; 220/266; 220/354; 220/380; 206/503; 206/508

[58] Field of Search ..... 220/306, 352, 356, 380, 220/284, 266, 307; 206/503, 508, 509, 520

[56] References Cited

U.S. PATENT DOCUMENTS

| | | | |
|---|---|---|---|
| 1,700,611 | 1/1929 | Freeman | 220/284 |
| 2,854,790 | 10/1958 | Hartung | 206/520 |
| 3,339,792 | 9/1967 | Biglin | 220/306 |
| 3,378,177 | 4/1968 | Gran | 220/308 |
| 3,516,571 | 6/1970 | Roper | 206/508 |
| 3,840,152 | 10/1974 | Hodge | 206/508 |
| 3,880,288 | 4/1975 | Hunter | 220/380 |
| 3,965,616 | 6/1976 | Ridgeway | 206/520 |
| 4,024,976 | 5/1977 | Acton | 220/306 |
| 4,027,775 | 6/1977 | Mygatt | 220/306 |
| 4,079,857 | 3/1978 | Crisci | 220/306 |

FOREIGN PATENT DOCUMENTS

| | | | |
|---|---|---|---|
| 2302239 | 2/1975 | France | 206/508 |
| 1489515 | 10/1977 | United Kingdom . | |

*Primary Examiner*—George E. Lowrance

*Attorney, Agent, or Firm*—Wegner, Stellman, McCord, Wood & Dalton

[57] ABSTRACT

A receptacle having an integral ring-shaped lock for engaging the depending rim of a cover. In order to prevent an undesirable opening said ring-shaped lock is reinforced by depending tips in a first weakened portion and supported by stays in a second weakened portion. The rim and the ring-shaped lock have interengaging conical surfaces. The cover has a depressed central area with an outer wall for engagement with the inner side of the receptacle wall.

11 Claims, 6 Drawing Figures

Fig.1
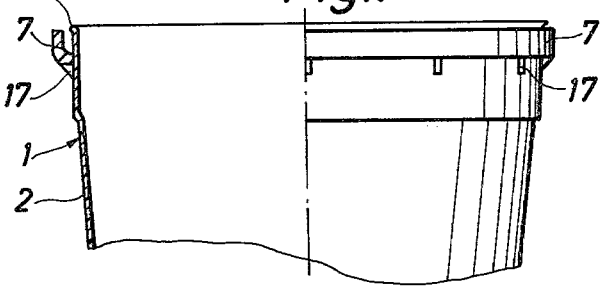
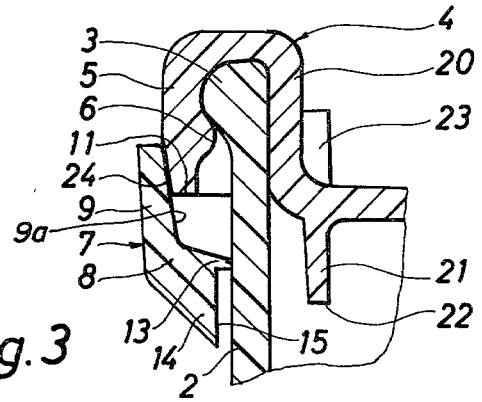
Fig.3
Fig.2
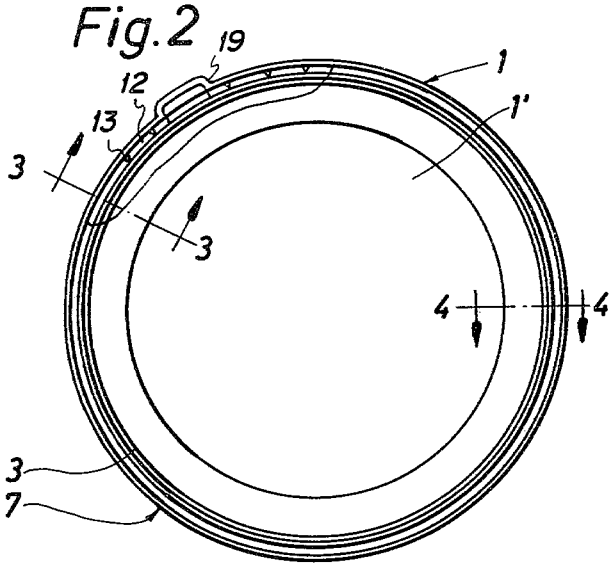
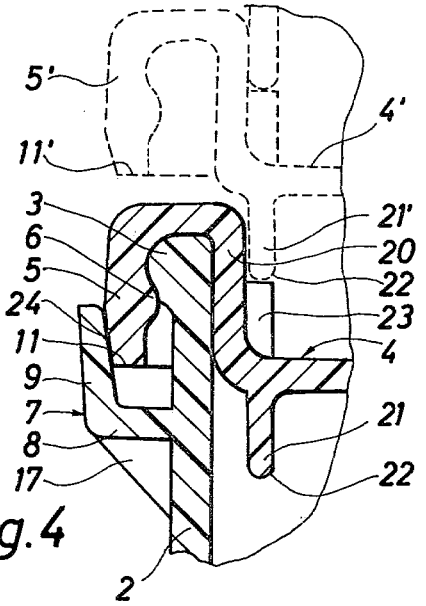
Fig.4
Fig. 5
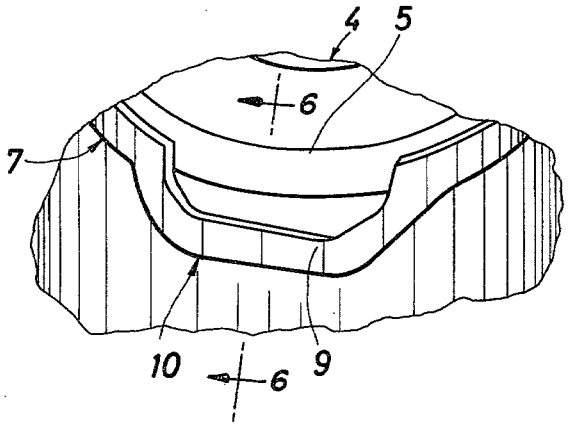
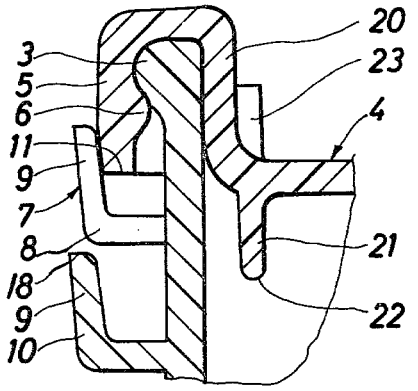
Fig. 6

RECEPTACLE WITH A COVER OF PLASTICS MATERIAL

BACKGROUND OF THE DISCLOSURE

The invention relates to a receptacle with a cover of plastics material, the cover having an outer depending flange which surrounds an upper rim portion of the receptacle body and has an inwardly projecting bead which engages the lower portion of an outwardly projecting bead on the receptacle body, and where a circumferential ring lock integral with the wall of the receptacle body has to be broken for obtaining access to the lower edge of the cover thereby ensuring that unwarranted opening of such a receptacle or container is evidenced by the broken lock.

During handling of known containers with such a cover, e.g. when a plurality of containers are to be arranged side by side in a transport box, unintentional opening of the container may happen, as an upward push on the lower edge of the skirt may result in the cover being pushed upwardly in relation to the container body, and this risk is greater the larger the container is in relation to the wall thickness of the container material.

Containers of plastics material are known having an annular protecting member which covers the lower edge of the cover skirt and which is connected to the container body by a line of weakness so that the protecting member can be removed by tearing along that line. The protecting member serves as a guarantee means which is adapted to indicate that somebody has tried to open the container or has opened the container.

Another example of the prior art is disclosed in British Pat. No. 1,489,515 describing a container having a lid of plastics material, which lid has a skirt surrounding an upper rim portion of the container body and has an inwardly projecting bead engaging a lower portion of an outwardly projecting bead on the container body, the outer surface of the container body carrying an annular protecting member which is generally L-shaped in cross-section, one end of a first portion of the protecting member passing beneath a lower edge of said skirt and being connected to the container body wall, part of the second portion of the protecting member being radially spaced from and surrounding at least a major part of the lower portion of the skirt.

The above-noted features provide a reasonable protection against unintentional opening of a container during handling, and the construction of the container is uncomplicated, with the result that such containers are readily manufactured and easy to use.

The known container may be constructed in one of two ways. Firstly, it may be constructed in such a way that a portion of the edge of the skirt is always accessible for manipulation, so that the cover may be removed without any special operation, and secondly, the container may be constructed in such a way that a certain length of the protecting member is adapted to be removed by means of a line or lines of weakening. However, it is possible for a prospective buyer of e.g. food articles in a supermarket to coax the lid open either in the area of the protecting member or in the area outside thereof, and by lifting the lid slightly, checking the contents by smelling or tasting. It has also proven possible to squeeze the sides of the container and thereby providing an internal pressure sufficient to press the lid off. This is contrary to all hygienic standards, and the known construction does not to a sufficient degree guarantee the integrity of the container.

SUMMARY OF THE INVENTION

Accordingly, it is the object of this invention to provide a ring lock for a receptacle, which ring lock is thus shaped that unwarranted access to the contents of the receptacle by partly lifting its cover always will be obvious to a subsequent buyer.

It is a further object of this invention to strengthen part or parts of the ring lock in such a way that it will be impossible to bend smaller portions thereof sufficiently downwards to coax the lid open without breaking the lock.

It is a further object of this invention to provide a ring lock which, when combined with a suitably constructed cover, will provide for co-operating outer and inner locking means thereby minimizing the risk for the cover slipping off by means of internal pressure or by squeezing the sides of the receptacle.

These and other objects of the present invention are attained by a receptacle having an external circumferential bead at or adjoining the top end thereof, the matching cover of plastics material having a depending resilient circumferential flange with an internal circumferential bead adapted to snap under said receptacle bead. The receptacle and the cover have interengaging surfaces at the top of the latter for tightly closing the receptacle. The cover flange has an extension depending below the flange bead.

The cover is formed with a depressed area essentially corresponding to the total area of the orifice of the receptacle. The lower surface of this cover area is preferably at essentially the same level of the lowermost edge of the flange or slightly below this level. The cover further comprises an integral upstanding annular wall with an outer surface snugly fitting with the inner surface of the receptacle wall. This cover comprises further an integral annular rib depending from the lower surface and spaced about the thickness of the wall from the inner surface of the receptacle, which rib acts as a guide for placing the cover on the recetacle and thereby hinders that the flange of a cover placed obliquely in a closing means hits the upper edge of the rib thereby unintentionally breaking it. This cover also comprises a multiplicity of supports integral with the cover wall and spaced along its inner surface. When a number of covers are stacked the cover ribs may be supported upon these supports in such manner that the lowermost edge of a circumferential flange of an upper cover is spaced from the outermost top surface of a lower, second cover, so that a gripping tool might be inserted betwee the covers for gripping and transferring the covers to a receptacle closing station.

The outer surface of the receptacle carries an outer ring-shaped lock with a generally L-shaped cross-section, which lock is placed near by the top end of the receptacle and comprises an annular ledge passing beneath a lower edge of the flange and being integral with the receptacle wall. At the outer end of the ledge it is integrally connected with an upwardly extending annular rib, which upwardly extending rib surrounds at least a major portion of the circumference of the depending flange of the cover. The first part of the circumferential length of the ledge is connected to the outer surface of the receptacle wall by at least one weakened zone, preferably by means of a multiplicity of weakened zones.

Each weakened zone is by means of a multiplicity of spaced connections between said ledge and said receptacle wall connected to said wall, said connections each having a reinforcing depending tip forming a stopping means for counteracting unwanted downward bending of the first part of the ledge, which movement might result in unwarranted access to the flange for lifting the cover from the receptacle. Each of these tips has a surface facing and parallel to and slightly spaced from said wall, thereby allowing for downwardly directed translational movement of the first part of the ledge when upon unwarranted intentional pressure against the annular rib the weakened zones are broken, which translational movement gives access to the lower edge of the flange for lifting the cover from the receptacle.

According to a further improvement of the invention the ledge has a second part comprising a multiplicity of depending web-shaped stays integral with the ledge and with the receptacle wall. These stays support the ring-shaped lock in this second part against unintentional or unwarranted downwardly directed pressure, which pressure might result in unwarranted access to the cover flange for lifting the cover from the receptacle.

According to a further improvement according to the invention a third small part of the circumferential length of the ring lock, which part is within the area of the above-mentioned first part. This third part is formed as a downwardly directed portion enabling access to be made to only a small circumferential segment of the lower edge of the cover flange to form a small gap between the lower edge of the flange and the upper edge of the rib. This makes it possible to insert a tool, such as a coin or a screwdriver, in the gap, the twisting of which will break the weakened zones and make it possible to exert an opening pressure upon the lower edge of the flange for breaking the lock and removing the cover from the receptacle.

According to the most preferred embodiment the depending flange of the cover and the upwardly directed rib of the ring-shaped lock have interengaging, essentially frusto-conical surfaces. These conical surfaces provide for a conical closure effect when the cover is pressed unto the receptacle thereby making any attempt to coax the cover off without breaking the ring lock virtually impossible. The above closure effect combined with the effect of the invented U-shape of the cover wall and depending flange, where the wall preferably ends at a lower level inside the receptacle than does the flange on the outside, ensures that the depending flange and the wall of the cover expand when pressed upon a receptacle, whereupon the depending flange is squeezed into place by means of said conical closure effect. The above U-shape of the wall and the depending flange alone ensure against the possibility of pressing the cover off by squeezing the receptacle, which effect is further enhanced by means of the interengaging conical surfaces between the depending flange and the upwardly extending rib.

BRIEF DESCRIPTION OF THE DRAWING

FIG. 1 shows the upper part of a receptacle according to the invention, partly in side view and partly in cross-section.

FIG. 2 is a top side view of a receptacle according to the invention, partly in section.

FIG. 3 is an enlarged cross-section through an upper part of the receptacle shown in FIGS. 1 and 2 and with a thereupon fastened cover, essentially taken along the plane for the line 3—3 in FIG. 2.

FIG. 4 is an enlarged cross-section through an upper part of the receptacle shown in FIGS. 1 and 2 and with a thereupon fastened cover, essentially taken along the plane for the line 4—4 in FIG. 2.

FIG. 5 is a fragmentary perspective view of the upper part of an alternative embodiment of the receptacle, with a cover fastened thereon.

FIG. 6 is a section taken substantially as indicated along the line 6—6 of FIG. 5.

Referring to the drawing, there is shown a receptacle embodying the ring lock sealing means and a cover for use therewith. A receptacle of the type illustrated may be used for food, paint and any other material where it is desired to ensure that the ultimate customer or user receives the receptacle in such a condition that he personally may check whether the receptacle has been opened or not during its transportation, storing and handling after the filling and closing at the producing plant and prior to his eventual opening of the receptacle.

Throughout the drawing the same reference numerals are used for indicating identical or corresponding parts.

The receptacle body is generally indicated at 1. The receptacle body has an outer wall 2 which in the shown embodiment has a circular cylindrical top end and tapers towards the bottom 1'. The wall has at or near the top an outer circumferential bead 3. On the upper portion of the receptacle body a cover 4 is mounted, the cover having an outer depending, resilient circumferential flange 5 surrounding the upper rim portion of the receptacle body and having an inwardly directed circumferential bead 6 which engages, as shown, the lower portion of the receptacle bead 3 and thereby constitutes a closing means for tightly closing the cover onto said receptacle. Beneath the flange bead 6 the flange 5 is continued in an extension thereof ending at the lower flange edge 11.

Below the lower edge 11 of the cover flange 5 the outer wall 2 of the container body carries an outer locking ring, or ring-shaped lock 7 which has an L- or J-shaped cross-section and functions as a protection for said depending cover flange 5. The ring-shaped lock 7 has an outwardly extending annular ledge 8 which is substantially perpendicular to the receptacle body wall 2, and integral therewith and integral with the ledge an upwardly extending annular rib 9 which is substantially parallel to the container body wall 2 and extends upwardly past and round about the lower portion of the depending cover flange 5, so that the lower portion of this flange 5 is covered.

The ring-shaped lock 7 is for a first part of the circumferential length of the ledge 8 connected to the container body wall 2 by means of a zone or zones of weakening 12 which are formed by spaced connections 13 between the ledge 8 and the container body wall 2, see especially FIGS. 2 and 3. This line of weakening may for special purposes extend along the whole circumferential length of the ring-shaped lock 7 around the receptacle body, or may only extend along a relatively short part of said circumferential length. This first part may for large receptacles constitute e.g. one eighth of the total circumference or less and for smaller receptacles be e.g. one quarter of the total circumference or mre. It has been discovered that unless these connections are reinforced a dexterous person might be able to cautiously bend the ledge 8 and it integral rib 9 without breaking the connections 13 thereby being able to coax the cover from the receptacle. He might also simply squeeze the sides of a flexible receptacle wall establishing sufficient pressure within the receptacle, so that the cover would be pressed off and he might smell at or pilfer from the contents thereof. This is, especially in connection with food articles a very unhygienic procedure and against regulations for sale of food from supermarkets. For counteracting this each connection has according to the invention a reinforcing depending tip 14, see FIG. 3, said tips each having a surface 15 facing and parallel to and slightly spaced from said wall 2. This makes a downwardly directed translational movement of the ring-shaped lock 7 possible upon warranted intentional pressure against the rib 9 for breaking the connections 13. First then access is given to the lower edge 11 of the flange 5 for removal of the cover 4 from the receptacle 1. As shown in FIG. 4, also the remaining or second part of the circumferential length of the ring-shaped lock may be reinforced in order to prevent pilfering. For this purpose this second part of the ring lock 7 comprises according to the invention a multiplicity of web-shaped stays 17 having about the same thickness as the wall 2 and the ledge 8, each stay 17 being integral with the ledge 8 and the wall 2 and depending from the ledge 8. The stays 17 may be spaced along the outer circumference having a mutual distance of between one and six cms, preferably between one and three cms, and most preferably two cms, the actually chosen spacing depending on the type of material chosen and the thickness of the ledge 8 and the wall 2.

In the embodiment shown in FIGS. 5 and 6 the ring-shaped lock 7 has a downwardly directed small third part within the area of the above-mentioned first, weakened part in the form of a portion 10 exposing the lower edge 11 of the cover flange 5, so that said edge is accessible for manipulation inside the downwardly directed portion 10, this making it possible to impose ressure, e.g. by means of a tool, such as a coin, screwdriver or the like, upon the lower exposed edge 11 of the cover flange 5 and upon the upper edge 18 of the portion 10, so that the ring-shaped lock can be intentionally broken and the cover 4 be loosened and removed.

As the ledge 8 extends unbroken along the lower edge of the downwardly bent portion 10 the cover flange 5 will be protected against accidental upwardly directed pressure and thrusts and thereby unintentional loosening.

As shown in FIG. 2, the rib 9 may in an alternate embodiment within the first part of the ring-shaped lock 7 include a portion shaped as a handle 19 by means of which the ring-shaped lock 7 may be drawn away from the container body, so that tearing occurs along at least a portion of the zone of weakening 12, so that at least a portion of the lower edge 11 of the cover flange 5 becomes accessible for manipulation in order to remove the cover.

Preferably the present invention comprises a receptacle 2 having a cover 4 of a plastics material. The cover 4 has an inwardly, from the rim of the receptacle 1 depending, circumferential leg 20 fitting snugly to the inner surface of the receptacle wall 2 and supporting a depressed portion of the cover 4. Depending from the lower surface of the depressed portion of the cover 4 and integral therewith and spaced from the inner surface of the receptacle wall 2 a distance essentially equal to the thickness of the leg 20 is a circumferential flange 21 with a pointed or rounded lower end 22. As shown, especially in FIG. 4, a plurality and at least three supports 23 are fixed to the inner side of the leg 20 and are integral therewith for supporting the lower ends 22' of the flanges 21' of a cover 4' which for stacking purposes is placed upon a lower cover 4. This feature enables the covers 4' to be packed, shipped and stored in stacked condition prior to inserting a cover 4 in the opening of a receptacle 1. Such stacking is indicated with dotted lines in FIG. 9, and more than two of such covers may be stacked on top of each other. The height of the supports 23 plus the height of the circumferential inner flange 22 is so great that the lower edge 11' of the outer flange 5' of an upper cover 4' when stacked is placed a distance from the uppermost surface of a lower cover 4 sufficiently to insert a gripping tool (not shown) for separating and lifting the individual covers to a station (not shown) for closing the receptacles. The height of the supports is about half the height of the leg 20, so that the inner flange 21 safely guides and maintains the covers when stacked. By this construction it is also ensured that the inner flange 21 safely guides the cover 4 to be correctly placed upon the rim of a receptacle 1 without any risk of the lower edge 11 of the outer flange 5 hitting and damaging the ring-shaped lock 7, should the cover 4 be lowered upon the receptacle at an oblique angle. A cover as shown in FIGS. 3–5 ensures that an unwarranted access to the contents of the receptacle by squeezing the walls thereof is made impossible due to the U-shape of the rim portion of the cover and especially due to the leg 20 extending further down than the ultimate point of contact between the outer depending flange 5 with the receptacle outside at beads 3, 6.

In the most preferred embodiment the depending flange 5 of the cover 4 has an outer biassed or bevelled circumferential surface 24 so as to provide an essentially frusto-conical lower part of the cover having its largest diameter at or approximately at the level of the lower portion of flange bead 6 and the smallest diameter at the edge 11. The inclination of this biassed surface 24 is identical with the inclination of the inwardly facing surface **9*a* of the ring lock rib 9 when the cover 4 is in its final position on the receptacle, the ring lock being thus shaped that these surfaces have the same distance from the receptacle wall 2. This feature ensures an outer conical sealing surface engagement making access to the cover edge for opening of the receptacle without breaking the ring lock virtually impossible. This feature further ensures that the depending flange 5, when a cover is being placed on a receptacle, is gripped by means of the interengaging surface and pressed correctly into place towards the receptacle. In this connection it is an advantage that the surface 15 of the tip 14 is spaced a distance from the outer surface of the receptacle wall sufficiently to permit a small outwardly directed bending of the ring lock in the area of the weakened zone. For this purpose this distance is between 0.5 and 5 mms, preferably between 1 and 3 mms, the normally preferred distance being 1.5 mm, the actually chosen distance depending upon the size of the receptacle, the type of material chosen and the thickness of the wall. Also the elasticity of the stays 17** should be sufficient to permit this intentional outward bending.

A further advantage by using a cover of the type shown in FIGS. 3–5 is that when an essentially conically shaped receptacle is used these may be formed in such a manner that they may be stacked with their bottom ends within the depressed portion of the cover.

This is especially an advantage during transportation and when stacking such receptacles for sale at an open space in a supermarket.

Although the receptacle in the drawings is shown and described above as an essentially conical receptacle with a circular circumference it is evident to a man known in the art that the receptacle as well might have vertical walls and, as seen from above, have an oval, an angular or essentially rectangular form or any other convenient shape.

It is to be understood that the receptacle and cover hereinbefore described may be changed within the scope of the invention as set forth, and I do not wish to be limited in the application thereof, except as I shall be limited by the principles hereinbefore set forth and by the appended claims.

I claim:

1. In a receptacle of the type which has a continuous sidewall with an open top end; an external circumferential bead on said sidewall substantially at said open top end, a cover of plastic material which has a depending circumferential flange provided with an internal circumferential bead which snaps beneath the lower portion of said external bead to tightly close the cover onto the receptacle sidewall, and a downward extension of said flange below said internal bead, the improvement comprising, in combination:

an integral external locking ring surrounding said receptacle sidewall, said locking ring being effectively L-shaped in cross section with a lower ledge beneath the cover flange and an upright annular rib encircling at least a major portion of the downward extension of the cover flange, an integral annular wall on said cover having an outwardly facing surface fitting snugly against the inner surface of the receptacle sidewall radially inwardly of said beads, connecting means connecting the locking ring lower ledge to the receptacle sidewall, said connecting means being defined at least in part by circumferentially spaced connections creating a zone of weakening, and reinforcing means extending downwardly from said spaced connections in close proximity to the container wall, said reinforcing means permitting rupture of said connections by a downward translational force applied to the locking ring parallel to the receptacle sidewall to give access to the lower edge of the cover flange to remove the cover from the container, while the close proximity of said reinforcing means to the container wall limits inward displacement of said reinforcing means and correspondingly limits outward displacement of said rib to a distance insufficient to give access to the lower edge of the cover flange, thereby to effectively prevent removal of said cover from the container as long as said connections remain unruptured.

2. The combination of claim 1 in which said downward extension of the cover flange has an outer surface which is inclined inwardly toward its lower end, and said upright rib of the locking ring has a complementary inwardly facing surface tightly engaging said inclined surface.

3. The combination of claim 1 in which said locking ring has a small offset portion in said zone of weakening to facilitate application of downward translational force to the locking ring.

4. The combination of claim 3 in which said offset portion is slightly below the lower edge of the cover flange to permit insertion of a broad thin tool which may be twisted to apply downward translational force to the locking ring to rupture the connections.

5. The combination of claim 3 in which said offset portion is positioned radially outwardly from the rest of the locking ring to provide a handle to which direct manual downward translational force may be applied.

6. The combination of claim 1 in which the zone of weakening connecting the locking ring to the receptacle wall occupies only a part of the circumference of said locking ring, while the rest of said locking ring is connected to the receptacle wall by a multiplicity of integral stays beneath the locking ring lower ledge to support the locking ring against movement and thereby prevent access to the lower edge of the cover flange.

7. The combination of claim 1 wherein said last named means comprises a plurality of depending tips essentially triangular in cross section and having an inner face effectively parallel to the container sidewall.

8. The combination of claim 1 in which the depending annular cover wall defines the perimeter of a depressed cover area, and there is a depending annular rib on the lower surface of said cover wall positioned and shaped to serve as a guide for placing the cover on the receptacle.

9. The combination of claim 8 which includes at least three circumferentially spaced upright supports integral with the upper surface of the depending annular cover wall and positioned to support a second cover stacked thereon with its annular rib resting on the upright supports.

10. The combination of claim 1 in which said integral wall of the cover includes a portion radially inwardly of said downward extension of said cover flange.

11. A cover of plastic material for a receptacle of the type which has a continuous sidewall with an open top end and an external circumferential bead substantially at said open top end, said cover comprising, in combination:

a transverse body area surrounded by an integral upstanding annular wall which has an outwardly facing surface for snugly fitting an inwardly facing surface of the container sidewall;

an integral depending circumferential cover flange spaced radially outwardly from said upstanding annular wall, said cover flange having an internal circumferential bead which is adapted to snap beneath the lower portion of the external bead on the receptacle sidewall and cooperates with said upstanding annular wall to firmly grip the upper marginal portion of the receptacle sidewall;

a depending annular rib on the lower surface of said body area, said annular rib being positoned and shaped to serve as a guide for placing the cover on a receptacle; and at least three circumferentially spaced upright supports integral with the upper surface of said body area, the position of said supports being such that a plurality of said covers may be arranged in a stack with the annular rib of an upper cover resting on the upright supports of a next lower cover, and the combined height of said upright supports and said angular rib being sufficient to space the lower edge of each cover flange sufficiently above the uppermost part of the next lower cover in the stack to receive a gripping tool therebetween for transferring an upper cover from the stack to a receptacle closing station.

* * * * *